US005972813A

United States Patent [19]

Polat et al.

[11] Patent Number: 5,972,813

[45] Date of Patent: Oct. 26, 1999

[54] TEXTURED IMPERMEABLE PAPERMAKING BELT, PROCESS OF MAKING, AND PROCESS OF MAKING PAPER THEREWITH

[75] Inventors: Osman Polat, Cincinnati; Ward William Ostendorf, West Chester; Robert Stanley Ampulski, Fairfield, all of Ohio

[73] Assignee: The Procter & Gamble Company, Cincinnati, Ohio

[21] Appl. No.: 08/992,285

[22] Filed: Dec. 17, 1997

[51] Int. Cl.[6] ..... D04H 1/08

[52] U.S. Cl. ..... 442/320; 162/358.1; 162/358.2; 162/358.3; 162/358.4; 156/900; 156/901

[58] Field of Search ..... 162/358.1, 358.2, 162/358.3, 358.4; 442/320; 156/900, 901

[56] References Cited

U.S. PATENT DOCUMENTS

| | | | |
|---|---|---|---|
| 3,537,954 | 11/1970 | Justus | 162/305 |
| 3,840,429 | 10/1974 | Busker et al. | 162/205 |
| 4,271,222 | 6/1981 | Hahn | 428/193 |
| 4,309,246 | 1/1982 | Hulit et al. | 162/113 |
| 4,312,907 | 1/1982 | Hiraoka et al. | 428/212 |
| 4,369,081 | 1/1983 | Curry et al. | 156/148 |
| 4,463,745 | 8/1984 | Acker . | |
| 4,483,745 | 11/1984 | Wicks et al. | 162/205 |
| 4,500,588 | 2/1985 | Lundstrom | 428/212 |
| 4,535,611 | 8/1985 | Masuda | 68/202 |
| 4,552,620 | 11/1985 | Adams | 162/358 |
| 4,588,475 | 5/1986 | Lunstrom | 162/205 |
| 4,752,519 | 6/1988 | Boyer et al. | 428/137 |
| 4,861,430 | 8/1989 | Anderson | 162/205 |
| 4,931,143 | 6/1990 | Karvinen et al. | 162/360.1 |
| 4,976,821 | 12/1990 | Laapotti | 162/360.1 |
| 5,098,522 | 3/1992 | Smurkoski et al. | 162/358 |
| 5,175,037 | 12/1992 | Merckens et al. | 428/57 |
| 5,178,732 | 1/1993 | Steiner et al. | 162/360.2 |
| 5,232,768 | 8/1993 | Eklund et al. | 428/234 |
| 5,238,537 | 8/1993 | Dutt | 162/358.4 |
| 5,298,124 | 3/1994 | Eklund et al. | 162/306 |
| 5,346,567 | 9/1994 | Barnewall | 156/78 |
| 5,364,504 | 11/1994 | Smurkoski et al. | 162/116 |
| 5,372,876 | 12/1994 | Johnson et al. | 428/233 |
| 5,389,205 | 2/1995 | Pajula et al. | 162/205 |
| 5,393,384 | 2/1995 | Steiner et al. | 162/359.1 |
| 5,468,349 | 11/1995 | Schiel | 162/358.2 |
| 5,500,277 | 3/1996 | Trokhan et al. | 428/196 |
| 5,514,523 | 5/1996 | Trokhan et al. | 430/320 |
| 5,556,509 | 9/1996 | Trokhan et al. | 162/111 |
| 5,674,663 | 10/1997 | McFarland et al. | 430/320 |
| 5,700,356 | 12/1997 | Lefkowitz | 162/358.1 |
| 5,820,730 | 10/1998 | Phan et al. | 162/112 |
| 5,837,103 | 11/1998 | Trokhan et al. | 162/358.2 |
| 5,865,954 | 2/1999 | Laapotti | 162/205 |
| 5,871,887 | 2/1999 | Trokhan et al. | 430/320 |

FOREIGN PATENT DOCUMENTS

| | | |
|---|---|---|
| WO 82/03595 | 10/1982 | WIPO . |
| WO 84/02873 | 8/1984 | WIPO . |
| WO 96/00812 | 1/1996 | WIPO . |

*Primary Examiner*—Terrel Morris
*Assistant Examiner*—Arti R. Singh
*Attorney, Agent, or Firm*—Larry L. Huston; Donald E. Hasse; E. Kelly Linman

[57] ABSTRACT

An impermeable papermaking belt. The papermaking belt has a back side and a sheet side. The sheet side of the papermaking belt is textured. The sheet side imparts structure, preferably differential density, to paper made on the impermeable belt. The papermaking belt may comprise photosensitive resin on the sheet side. The papermaking belt may be used in conjunction with an imprinting roll which densifies the regions of the paper coincident the knuckles of the papermaking belt. This belt is suitable for papermaking machines having or not having a Yankee drying drum.

6 Claims, 4 Drawing Sheets

TEXTURED IMPERMEABLE PAPERMAKING BELT, PROCESS OF MAKING, AND PROCESS OF MAKING PAPER THEREWITH

FIELD OF THE INVENTION

The present invention relates to belts for use in papermaking, particularly to impermeable belts which reduce the risk of re-wetting the paper sheet, and more particularly to impermeable belts which produce structured tissue paper, the paper made therewith, and a process of making such paper and belt.

BACKGROUND OF THE INVENTION

Papermaking belts are well-known in the art. Papermaking belts are used to dewater and transport cellulosic fibers in a papermaking machine. The cellulosic fibers become an embryonic web and, upon drying, the finished product.

Typically, papermaking belts do not impart structure to the paper made thereon. "Structure" refers to variations in the basis weight and/or, more particularly, the density of the paper which are greater than occur in ordinary papermaking and due to ordinary variations, such as those induced by creping or wet micro-contraction. Such papermaking belts may be through air drying belts or conventional press felts. Such belts comprise a framework and a reinforcing structure through which water is removed.

Structured paper is consumer preferred because the paper can be softer, more absorbent, and utilize less fibers. However, producing structured paper typically has required through air drying, which can be costly.

The disadvantage to the aforementioned types of papermaking belts which are known to produce structured paper is that such papermaking belts are pervious to water. By being water pervious, the belts risk re-wet. Re-wet occurs when water removed from the paper being made on the belt is transferred away from the paper, then back to the paper. Re-wet occurs for many reasons. The typical cause of re-wet includes excess water carried by the felt to the point of introduction of the paper thereon.

Impermeable belts are also known in the art. For example, one impermeable belt has been commercially sold under the name Trans-belt by Albany International of Albany, N.Y. The Trans-belt, as well as other impermeable belts according to the prior art, suffer from the disadvantage that they do not produce structured paper when used as intended.

One attempt in the art to get around this disadvantage is to provide a patterned imprinting roll. The patterned imprinting roll is juxtaposed with the impermeable belt to form a nip therebetween. The paper travels through the nip between the belt and the patterned imprinting roll. In the nip, a pattern is imprinted on the paper yielding structured paper.

The structured paper then travels to a pressure roll where the paper is impressed in a second nip between the pressure roll and a Yankee drying drum. However, at the pressure roll, the structure previously imprinted into the paper is diminished or even lost, due to the compaction at this second nip. The compaction at this second nip between the pressure roll and the Yankee flattens the paper, causing the structure created at the nip between the trans-belt and the imprinting roll to be lost.

This invention provides a papermaking machine with an impermeable belt. Furthermore, this invention provides a belt for use in such a papermaking machine and which produces structured paper. This invention produces structured paper on an impermeable belt without diminishing the structure during steps incident to the manufacturing process.

SUMMARY OF THE INVENTION

The invention comprises an impervious papermaking belt. The impervious papermaking belt has two opposed sides, a sheet side and a back side. The sheet side imparts structure to the paper during papermaking. The sheet side of the papermaking belt is textured.

DETAILED DESCRIPTION OF THE INVENTION

Figure 1:
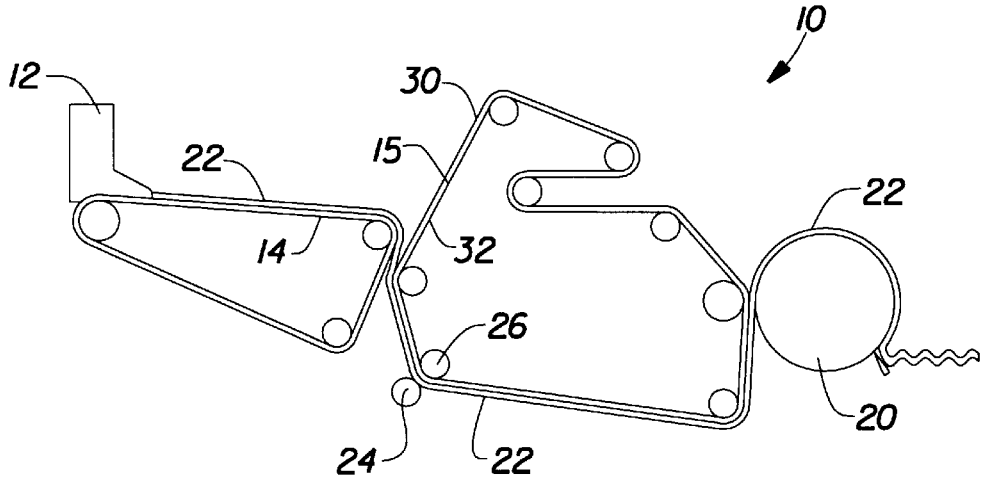
FIG. 1 is a vertical side elevational view of an exemplary papermaking machine according to the prior art having an impermeable belt according to the present invention in the press section.

Referring to FIG. 1, an exemplary papermaking machine 10 according to prior art is shown. The papermaking machine 10 has a headbox 12. The headbox 12 distributes a slurry of cellulosic fibers dispersed in a liquid carrier onto a forming wire 14. The carrier drains through the forming wire 14 yielding an embryonic web of paper 22.

The paper 22 is transferred from the forming wire 14 to an impervious drying fabric. The impervious fabric is disposed in the press section of the papermaking machine 10. The paper 22 is transferred from the drying fabric to any drying means known in the art. Exemplary drying means include infrared dryers, through air dryers, and optionally a Yankee drying drum 20. The paper 22 may be foreshortened using means well-known in the art.

If desired, while on the drying fabric, the paper 22 may be impressed between two rolls, a pressure roll 24 and a backing roll 26. The pressure roll 24 and backing roll 26 are juxtaposed to form a nip therebetween. The paper 22 passes through this nip, squeezing out some of the water contained in the paper 22. If desired, an optional felt may be interposed between the paper 22 and the pressure roll 24.

The paper 22 may also be foreshortened, as is known in the art. Foreshortening can be accomplished by creping the paper 22 from a rigid surface, preferably from a cylinder. The Yankee drying drum 20 is commonly used for this purpose. Creping is accomplished with a doctor blade as is well known in the art. Creping may be accomplished according to commonly assigned U.S. Pat. No. 4,919,756, issued Apr. 24, 1992 to Sawdai, the disclosure of which is incorporated herein by reference. Alternatively or additionally, foreshortening may be accomplished via wet microcontraction as taught in commonly assigned U.S. Pat. No. 4,440,597, issued Apr. 3, 1984 to Wells et al., the disclosure of which is incorporated herein by reference.

But for the impermeable belt 15 of the present invention, the paper 22 created on the papermaking machine 10 of FIG.

1 structured, due to the absence of any means to impart differential basis weight or, preferably, differential density to the paper 22. As used herein "structured" paper 22 has regions of mutually different basis weight or density disposed throughout the paper in a nonrandom repeating pattern.

An attempt to improve upon the papermaking machine 10 of FIG. 1 utilizes an impermeable drying fabric and a patterned imprinting roll. The patterned imprinting roll imprints the paper 22 in the nip between the patterned printing roll and the backing roll 26, as discussed above. By imprinting the paper 22, structure is formed in the paper 22. However, the structure only lasts until the paper 22 is passed through the nip formed between a dry transfer roll and the Yankee drying drum 20. At this nip, much, if not all, of the structure is compressed out of the paper 22, essentially returning it to nearly its original flat condition.

Figure 2:
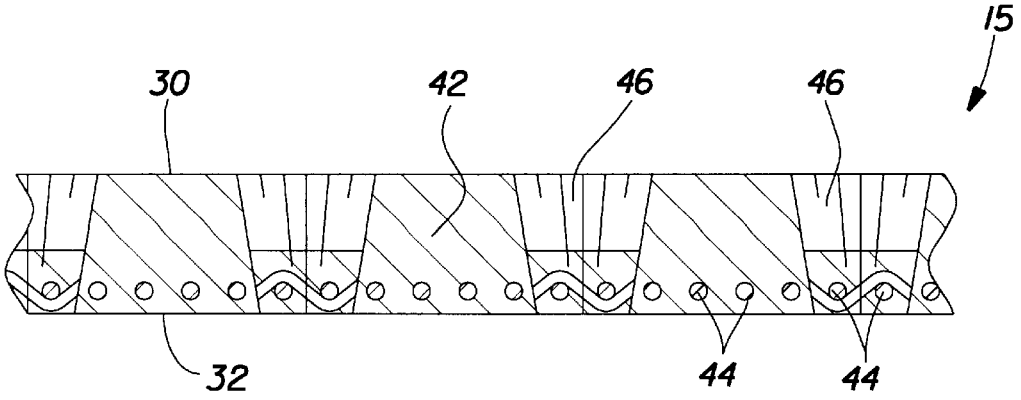
FIG. 2 is a fragmentary vertical side elevational view of a papermaking belt according to the present invention.

Referring to FIG. 2, the belt 15 according to the present invention is impermeable and imparts a pattern to the paper 22 made thereon. The belt according to the present invention has a sheet side 30 and a back side 32. The sheet side 30 is textured and is that side which contacts, carries, and imparts structure to the paper 22 in ordinary use. The back side 32 of the belt contacts the papermaking machine 10 and particularly the drive and driven rolls of the papermaking machine 10 during papermaking. Generally the sheet side 30 of the belt is outwardly facing and the back side 32 of the belt is inwardly facing.

The papermaking belt 15 according to the present invention is macroscopically monoplanar. The plane of the papermaking belt 15 defines its X-Y directions. Perpendicular to the X-Y directions and the plane of the papermaking belt 15 is the Z-direction of the belt 15. Likewise, the paper 22 according to the present invention can be thought of as macroscopically monoplanar and lying in an X-Y plane. Perpendicular to the X-Y directions and the plane of the paper 22 is the Z-direction of the paper 22.

Examining the belt 15 in more detail, the belt 15 according to the present invention comprises two primary components: a framework 42 and a reinforcing structure 44. The framework 42 is disposed on the sheet side of the belt 15 and defines the texture. The framework 42 preferably comprises a cured polymeric photosensitive resin.

The texture of the framework 42 defines a predetermined pattern, which imprints a like pattern onto the paper 22 of the present invention. A particularly preferred pattern for the framework 42 is an essentially continuous network. If the preferred essentially continuous network pattern is selected for the framework 42, discrete blind holes 46 will extend between the first surface and the second surface of the belt 15. The essentially continuous network surrounds and defines the blind holes 46.

The second surface of the belt 15 is the machine contacting surface of the belt 15. The second surface may be made with a backside network having passageways therein which are distinct from the blind holes 46. The passageways provide irregularities in the texture of the backside of the second surface of the belt 15. The passageways allow for air leakage in the X-Y plane of the belt 15, which leakage does not necessarily flow in the Z-direction through the blind holes 46 of the belt 15.

The second primary component of the belt 15 according to the present invention is the reinforcing structure 44. The reinforcing structure 44, like the framework 42, has a first or paper facing side and a second or machine facing surface opposite the paper 22 facing surface. The reinforcing structure 44 is primarily disposed between the opposed surfaces of the belt 15 and may have a surface coincident the backside of the belt 15. The reinforcing structure 44 provides support for the framework 42. If one does not wish to use a woven fabric for the reinforcing structure 44, a nonwoven element, screen, net, or a plate having a plurality of holes therethrough may provide adequate strength and support for the framework 42 of the present invention.

The belt 15 according to the present invention may be made according to any of commonly assigned U.S. Pat. No. 4,514,345, issued Apr. 30, 1985 to Johnson et al.; U.S. Pat. No. 4,528,239, issued Jul. 9, 1985 to Trokhan; U.S. Pat. No. 5,098,522, issued Mar. 24, 1992; U.S. Pat. No. 5,260,171, issued Nov. 9, 1993 to Smurkoski et al.; U.S. Pat. No. 5,275,700, issued Jan. 4, 1994 to Trokhan; U.S. Pat. No. 5,328,565, issued Jul. 12, 1994 to Rasch et al.; U.S. Pat. No. 5,334,289, issued Aug. 2, 1994 to Trokhan et al.; U.S. Pat. No. 5,431,786, issued Jul. 11, 1995 to Rasch et al.; U.S. Pat. No. 5,496,624, issued Mar. 5, 1996 to Stelljes, Jr. et al.; U.S. Pat. No. 5,500,277, issued Mar. 19, 1996 to Trokhan et al.; U.S. Pat. No. 5,514,523, issued May 7, 1996 to Trokhan et al.; U.S. Pat. No. 5,554,467, issued Sep. 10, 1996, to Trokhan et al.; U.S. Pat. No. 5,566,724, issued Oct. 22, 1996 to Trokhan et al.; U.S. Pat. No. 5,624,790, issued Apr. 29, 1997 to Trokhan et al.; and U.S. Pat. No. 5,628,876, issued May 13, 1997 to Ayers et al., the disclosures of which are incorporated herein by reference. The framework 42 may be applied to a felt reinforcing structure 44 as taught by commonly assigned U.S. Pat. No. 5,556,509, issued Sep. 17, 1996 to Trokhan et al.; U.S. Pat. No. 5,580,423, issued Dec. 3, 1996 to Ampulski et al.; U.S. Pat. No. 5,609,725, issued Mar. 11, 1997 to Phan; U.S. Pat. No. 5,629,052 issued May 13, 1997 to Trokhan et al.; U.S. Pat. No. 5,637,194, issued Jun. 10, 1997 to Ampulski et al. and U.S. Pat. No. 5,674,663, issued Oct. 7, 1997 to McFarland et al., the disclosures of which are incorporated herein by reference.

A suitable belt 15 according to present invention may be made utilizing photosensitive resin as described above. An exemplary method of making such a belt 15 is described in several of the aforementioned patents incorporated by reference. However, deviations from the prior art necessary to accomplish the manufacturing process are set forth below.

First, liquid photosensitive resin is provided. The resin is disposed on a backing surface, commonly a large roll. A mask having transparent and opaque regions is juxtaposed with and preferably placed over the photosensitive resin. Actinic radiation is passed through the transparent regions of the mask. The radiation passing through the transparent regions of the mask cures the resin therebeneath to yield an impermeable belt 15.

However, it is important that the belt 15 be not only impermeable but also textured on the sheet side 30. By "texture" it is meant that the belt 15 has a topography which functionally imprints structure into the paper 22, and more particularly imparts differential density to the paper 22, during normal papermaking. The texture has Z-direction asperities exceeding those produced by the normal and ordinary beltmaking process used for impermeable belts. Preferably the asperities have a depth in the Z-direction of at least about 0.002 inches, more preferably at least about 0.005 inches, more preferably still at least about 0.010 inches, and still more preferably at least about 0.015 inches, but preferably not more than 0.050 inches. A preferred range is for producing an absorbent, thick, soft aesthetically pleasing tissue paper is about 0.010 to 0.030 inches.

The texture is imparted to the belt 15 as follows. Radiation is bombarded on the belt 15 both in the direction perpendicular to the plane of the belt 15 and in off-axis, i.e., non-perpendicular directions. By providing off-axis radiation, the resin registered with, but beneath, the opaque regions of the mask is cured, along with the resin registered with the transparent regions of the mask. However, such curing beneath the opaque regions occurs at a finite depth below the mask. The regions of the resin immediately beneath the opaque regions of the mask will not cure, due to the incident angle of the radiation. The off-axis, i.e., non-perpendicular, radiation must be sufficient to cure the resin throughout the X-Y plane of the belt 15. For the embodiment described herein, a mask having oval shaped opaque areas with major axes in the X-Y plane of 0.08 and 0.06 inches, and actinic radiation varying from the perpendicular at an angles of from about plus or minus 10 degrees has been found suitable to produce asperities, in the form of blind holes 46 having a depth of about 0.015 inches.

The radiation may be off-axis from the source or from scattering upon reflection in the reinforcing structure 44. Of course, it will be recognized by one of ordinary skill that the X-Y dimension of the asperity will match the X-Y dimension of the opaque region in the mask.

The belt described herein is considered impermeable to water. By "impermeable," it is meant that the belt transmits no water through capillaries having any one dimension of 50 microns or greater.

If desired, the impermeable belt 15 may be made in several other embodiments. For example, it is not necessary that the impermeable belt 15 utilize a reinforcing structure 44. If desired, the impermeable belt 15 may be made of the photosensitive resin, described above, cast on a surface not having a reinforcing structure 44. Polyurethane foams have also successfully been used to render belts impermeable, as illustrated by the commercially available Trans-belt. Alternatively and prophetically, rubber and silicone coatings may be utilized to render the belt impervious. The material which renders the belt impervious may be applied by any known means such as printing, spraying, blade coating, other coating technologies, or preferably impregnating. Impregnating occurs by immersing the belt in a bath of the substance.

Suitably, the belt according to the present invention may be made with a texture comprising semi-continuous, continuous or discrete patterns or combinations thereof in the X-Y plane of the belt. If a discrete pattern is desired a papermaking belt having discrete outwardly extending knuckles may be utilized. Such a suitable belt according to the present invention may be made by starting with the belt disclosed in commonly assigned U.S. Pat. No. 4,239,065, issued to Trokhan, the disclosure of which is incorporated herein by reference, or with a Spectra Membrane sold by Scapa Group of England. Either the aforementioned belt made according to the commonly assigned U.S. Pat. No. 4,239,065 or the Spectra belt is immersed in liquid resin to a depth which does not immerse the outwardly extending knuckles of the belt. The resin is cured as described above rendering the belt impermeable, but leaving the knuckle pattern so that the impermeable belt 15 retains its original sheet side 30 texture.

After a belt 15 has been rendered impermeable by any means or material, the texture may be imparted to the belt 15 by casting photosensitive resin thereon, as described above. Alternatively, the texture may be provided by stitching, or selectively removing material from the belt. The texture, without regard to how it is imparted or the belt is made, may comprise any desired X-Y pattern. The texture may be discontinuous, semi-continuous, or preferably be continuous.

One prophetically preferred embodiment utilizes an impermeable conventional felt. The impermeable felt has material applied to the back side 32 which renders the felt impermeable. Then, the top side of the belt is provided with absorbent knuckles by stitching the knuckles into the sheet side 30 of the felt. In this manner, an impermeable felt having knuckles which impart texture and also absorb water from the paper 22 is provided. As used herein, knuckles refer to a pattern raised above the plane of the sheet side 30 of the belt and extending outwardly therefrom.

Figure 3:
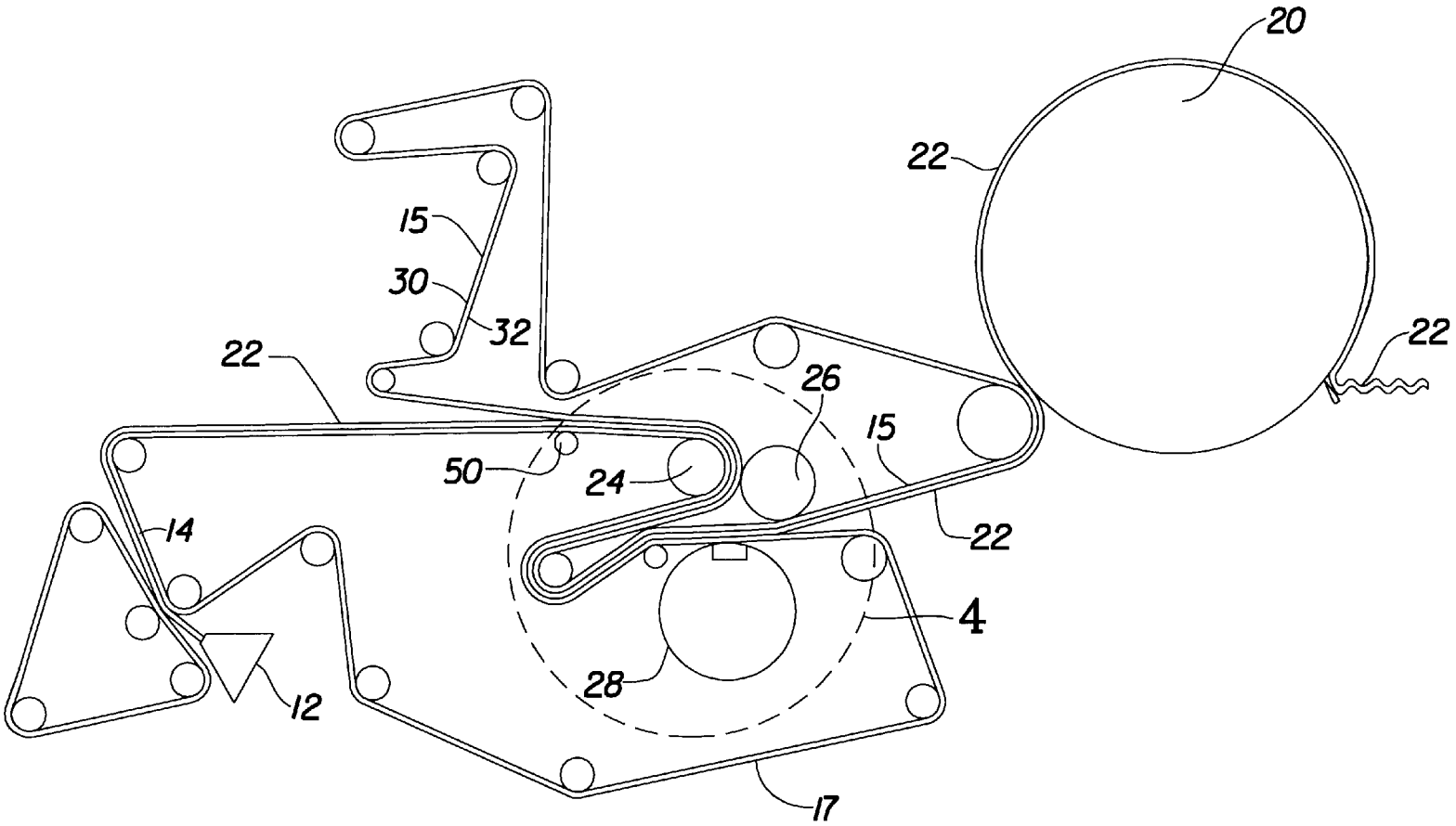
FIG. 3 is a vertical side elevational view of a twin wire papermaking machine according to the present invention.
Figure 4:
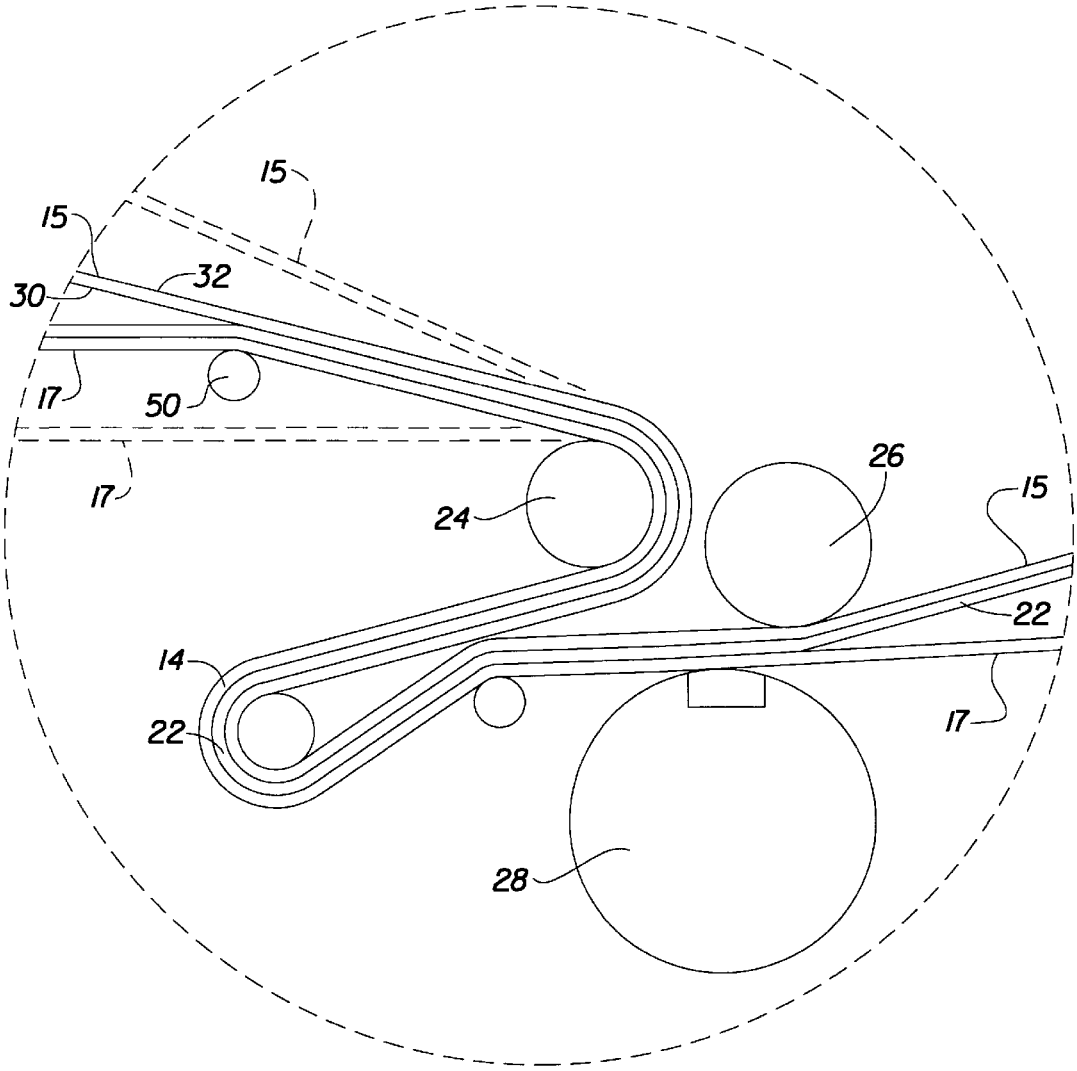
FIG. 4 is a fragmentary enlarged vertical side elevational view of the papermaking machine of FIG. 3 showing a less preferred, but acceptable, clothing run in the dashed lines and the preferred clothing run in the solid lines.

Referring to FIGS. 3–4, the belt according to present invention is employed in the papermaking machine 10 without significantly altering its original configuration. Two nips are preferably provided in the papermaking machine 10 according to the present invention, although the single nip configuration described above will suffice. In the preferred two nip configuration, a backing roll 26 is juxtaposed with a vacuum pressure roll 24 to form a first nip and an imprinting roll 28 to form a second nip. The vacuum pressure roll 24 dewaters the paper 22, increasing its consistency. The impermeable belt 15 imprints the paper 22, imparting structure thereto at the nip between the imprinting roll 28 and the backing roll 26.

Figure 5:
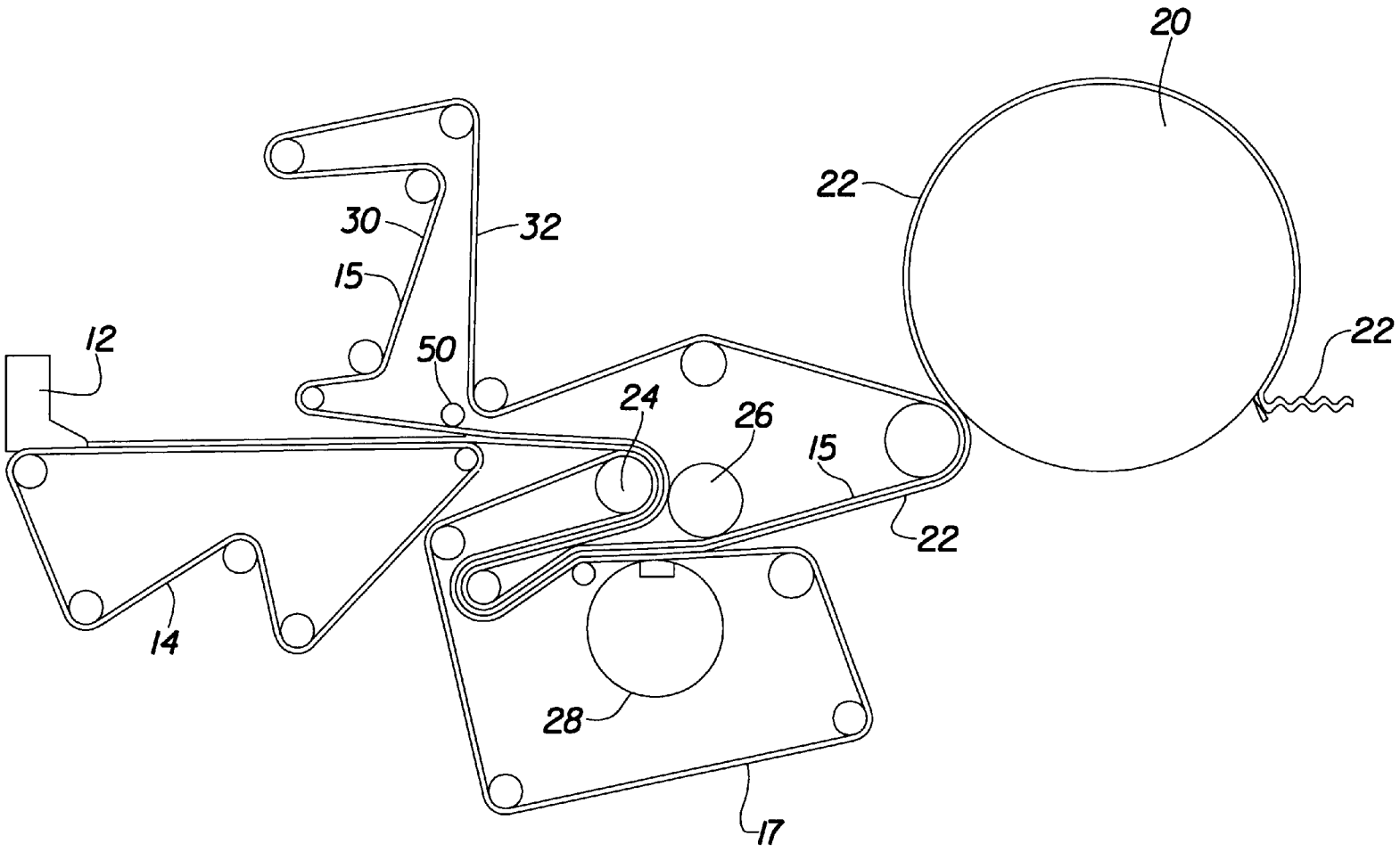
FIG. 5 is a vertical side elevational view of a fixed roof papermaking machine according to the present invention, having a separate press felt.

One of skill will understand that, depending on the desired papermaking machine 10 configuration, it may be necessary to select a twin wire configuration, as is known in the art. In this case, the paper 22 will not be carried to the impermeable belt 15 on a forming wire 14, but instead on a felt 17. Referring to FIG. 5, the paper 22 may be transferred from a forming wire 14 to an impermeable belt 15, then carried to the nip where a felt 17 may also be used.

It is important that the transfer of the paper 22 from the forming wire 14 or felt 17 to the impermeable belt 15 be feasible without utilizing a vacuum assist, since this would not be feasible with the impermeable belt 15. Thus, it is has been found helpful to have the impermeable belt 15 distended towards the forming wire 14 as illustrated. In this arrangement, the forming wire 14 and impermeable belt 15 preferably converge at an included angle of 1 to 45 degrees, although an angle as great as 90 degrees may be suitable. The convergance may be assisted by a turning bar or idler roll 50 as shown in the figures. Alternatively, the turning bar or idler roll 50 may be oppositely disposed from that indicated in the figures, so that the tension and compression sides of the forming wire 14 and impermeable belt 15, and the sense of the centrifugal force, are transposed. The forming wire 14 and belt then run together for a suitable distance.

If desired, the papermaking machine 10 may use an extended nip press as the imprinting roll 28. Suitable extended nip presses may be made according to U.S. Pat. No. 5,650,049, issued Jul. 22, 1997 to Kivimaa et al. and assigned to Valmet; U.S. Pat. No. 5,662,777, issued Sep. 2, 1997 to Schiel et al. and assigned to Voith; or Patent Application WO 95/16821, published Jun. 21, 1995 in the name of Mentele and assigned to Beloit, the disclosures of which are incorporated herein by reference.

In the present invention, the paper 22 maintains the registration with the texture of the belt up to and until the paper 22 is transferred to the Yankee drying drum 20, the structure imparted to the paper 22 is not lost upon transfer. Of course, it is to be recognized that the paper 22 may be finally dried in any number of ways without destroying its structure. The Yankee drying drum 20 is only one exemplary embodiment of known drying methods and apparatuses.

What is claimed is:

1. An impervious papermaking belt, said impervious papermaking belt having a sheet side and a back side opposed thereto, wherein said surface of said sheet side has a pattern which is imparted to paper made thereon during papermaking.

2. A papermaking belt, said papermaking belt being impervious and having a sheet side and a back side opposed thereto, said sheet side of said papermaking belt being textured.

3. A papermaking belt according to claim 2 wherein said belt comprises photosensitive resin, said photosensitive resin being disposed on said sheet side of said belt.

4. A papermaking belt according to claim 3 wherein said photosensitive resin comprises an essentially continuous network.

5. A papermaking belt according to claim 3 wherein said belt further comprises a reinforcing structure.

6. A papermaking belt according to claim 5 wherein said reinforcing structure comprises a felt.

* * * * *

UNITED STATES PATENT AND TRADEMARK OFFICE

CERTIFICATE OF CORRECTION

PATENT NO. : 5,972,813
DATED : October 26, 1999
INVENTOR(S) : Osman Polat et al.

It is certified that error appears in the above-identified patent and that said Letters Patent is hereby corrected as shown below:

Column 3,
Line 1, after 1, insert -- would not be --.

Signed and Sealed this

Twenty-sixth Day of February, 2002

*Attest:*

*Attesting Officer*

JAMES E. ROGAN
*Director of the United States Patent and Trademark Office*